US009322559B2

(12) United States Patent
Pinson et al.

(10) Patent No.: US 9,322,559 B2
(45) Date of Patent: Apr. 26, 2016

(54) FUEL NOZZLE HAVING SWIRLER VANE AND FUEL INJECTION PEG ARRANGEMENT

(71) Applicant: General Electric Company, Schenectady, NY (US)

(72) Inventors: Mark William Pinson, Greer, SC (US); Gregory Earl Jensen, Greenville, SC (US); Jason Charles Terry, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 430 days.

(21) Appl. No.: 13/864,708

(22) Filed: Apr. 17, 2013

(65) Prior Publication Data

US 2014/0311150 A1 Oct. 23, 2014

(51) Int. Cl.

| | |
|---|---|
| ***F23R 3/28*** | (2006.01) |
| ***F23R 3/14*** | (2006.01) |
| *F23D 14/24* | (2006.01) |
| *F23R 3/32* | (2006.01) |

(52) U.S. Cl.

CPC . *F23R 3/286* (2013.01); *F23R 3/14* (2013.01); *F23D 14/24* (2013.01); *F23D 2900/14004* (2013.01); *F23D 2900/14021* (2013.01); *F23R 3/32* (2013.01)

(58) Field of Classification Search

CPC ..... F23R 3/14; F23R 3/286; F23R 3/28; F23R 3/32; F23D 2900/14021; F23D 2900/14004; F23D 2900/14701; F23D 14/64; F23D 14/24; F23C 2900/07001; F23C 7/004

USPC ..... 60/737, 740, 742, 746, 747, 748

See application file for complete search history.

(56) References Cited

U.S. PATENT DOCUMENTS

| | | | | |
|---|---|---|---|---|
| 5,404,711 | A * | 4/1995 | Rajput | F23D 14/02 239/400 |
| 5,407,347 | A * | 4/1995 | Bortz | F23C 6/045 431/116 |
| 5,590,529 | A * | 1/1997 | Joshi | F23R 3/38 239/403 |
| 5,613,363 | A * | 3/1997 | Joshi | F23C 7/004 239/403 |
| 5,673,552 | A * | 10/1997 | Idleman | F23C 7/004 60/39.23 |
| 5,685,139 | A * | 11/1997 | Mick et al. | 60/776 |
| 5,943,866 | A * | 8/1999 | Lovett | F23R 3/286 431/114 |
| 6,070,410 | A | 6/2000 | Dean | |
| 6,095,791 | A * | 8/2000 | Senior | F23C 7/00 431/12 |
| 6,438,961 | B2 | 8/2002 | Tuthill et al. | |
| 6,460,345 | B1 | 10/2002 | Beebe et al. | |
| 6,786,047 | B2 | 9/2004 | Bland | |
| 6,993,916 | B2 | 2/2006 | Johnson et al. | |
| 7,171,813 | B2 * | 2/2007 | Tanaka et al. | 60/737 |
| 7,181,916 | B2 * | 2/2007 | Ziminsky et al. | 60/776 |
| 7,966,820 | B2 * | 6/2011 | Romoser | 60/742 |
| 8,113,000 | B2 | 2/2012 | Laster et al. | |

(Continued)

*Primary Examiner* — Phutthiwat Wongwian
*Assistant Examiner* — Alain Chau
(74) *Attorney, Agent, or Firm* — Dority & Manning, PA

(57) ABSTRACT

A fuel nozzle for use in a gas turbine includes a pre-mix flow passage for directing a flow segment of a flow of a working fluid through the fuel nozzle. A first swirler vane and a second swirler vane extend within the pre-mix flow passage. The first swirler vane provides a first wake region within the flow segment. The second swirler vane provides a second wake region within the flow segment. A fuel injection peg is disposed downstream from the first swirler vane and the second swirler vane. The fuel injection peg is positioned within the flow segment between the first wake region and the second wake region.

10 Claims, 6 Drawing Sheets

(56) References Cited

U.S. PATENT DOCUMENTS

| | | | | |
|---|---|---|---|---|
| 8,136,359 | B2 * | 3/2012 | Stuttaford | F23R 3/286 60/737 |
| 2003/0014975 | A1 * | 1/2003 | Nishida et al. | 60/737 |
| 2008/0280238 | A1 * | 11/2008 | Smith et al. | 431/9 |
| 2010/0058767 | A1 | 3/2010 | Simons et al. | |
| 2010/0095675 | A1 * | 4/2010 | Lacy et al. | 60/737 |
| 2010/0255435 | A1 | 10/2010 | Singh et al. | |
| 2011/0173983 | A1 * | 7/2011 | Pinson et al. | 60/742 |
| 2011/0225973 | A1 * | 9/2011 | Romig | F23R 3/286 60/737 |

* cited by examiner

FUEL NOZZLE HAVING SWIRLER VANE AND FUEL INJECTION PEG ARRANGEMENT

FIELD OF THE INVENTION

The present invention generally relates to a fuel nozzle for use in a pre-mix combustor of a gas turbine. More particularly, this invention relates to a fuel nozzle having a pre-mix flow passage.

BACKGROUND OF THE INVENTION

A typical gas turbine includes an inlet section, a compressor section, a combustion section, a turbine section, and an exhaust section. The inlet section cleans and conditions a working fluid (e.g., air) and supplies the working fluid to the compressor section. The compressor section progressively increases the pressure of the working fluid and supplies a compressed working fluid to the combustion section. The compressed working fluid and a fuel are mixed within the combustion section and burned in a combustion chamber to generate combustion gases having a high temperature and pressure. The combustion gases are routed along through a hot gas path into the turbine section where they expand to produce work. For example, expansion of the combustion gases in the turbine section may rotate a shaft connected to a generator to produce electricity.

The combustion section generally includes one or more combustors annularly arranged and disposed between the compressor section and the turbine section. Various parameters influence the design and operation of the combustors. For example, gas turbine manufacturers are regularly tasked to increase gas turbine efficiency without producing undesirable air polluting emissions. The primary air polluting emissions typically produced by gas turbines burning conventional hydrocarbon fuels are oxides of nitrogen (NOx), carbon monoxide (CO), and unburned hydrocarbons (UHCs). Oxidation of molecular nitrogen and thus the formation of NOx in air breathing engines such as gas turbines is an exponential function of temperature. The higher the temperature of the combustion gases, the higher the rate of formation of the undesirable NOx emissions.

One way to lower the temperature of the combustion gases, thus controlling the formation of NOx, is to pre-mix fuel and air using a fuel injector or fuel nozzle that includes a plurality of swirler vanes disposed in a pre-mix flow passage and a plurality of fuel injection ports disposed upstream from or along an outer surface of the swirler vanes to create a lean combustible mixture in a pre-mix chamber of the combustor prior to injection into the combustion chamber. During combustion, the heat capacity or thermal capacitance of the excess air present in the air rich or lean combustible mixture absorbs heat in the combustion chamber, thus reducing the temperature of the combustion gases, thereby decreasing or preventing the formation of NOx emissions.

A flashback or flame holding condition may occur in combustors having pre-mix chambers for various reasons. Flashback typically occurs when flame propagates upstream from the combustion chamber into the pre-mix chamber, typically caused by momentary transient conditions. Flame holding typically occurs when a flame is initiated in the pre-mixing chamber. The flame then stabilizes in a recirculation zone or weak boundary layer zone formed immediately downstream of a portion of the swirler assembly where fuel is discharged into the pre-mix chamber. For example, the recirculation zone may be formed due to flow disturbances caused in part by the fuel pegs.

In some combustors, a non-symmetric flow in the vicinity of an injection point where the lean combustible mixture enters the combustion chamber plays a key factor in promoting flame holding. As a result, the flow field of the lean combustible mixture exiting the pre-mixer and entering the combustion chamber at the injection point should be uniform or symmetric in order to reduce the potential for flame holding and to achieve desired emissions performance.

Flashback and/or flame holding conditions within the combustor may result in undesirable thermal stresses on the fuel nozzles, thereby adversely affecting the mechanical life of the fuel nozzles, the swirlers and/or the combustor. Accordingly, an improved fuel nozzle that reduces flashback and/or flame holding within a combustor would be useful.

BRIEF DESCRIPTION OF THE INVENTION

Aspects and advantages of the invention are set forth below in the following description, or may be obvious from the description, or may be learned through practice of the invention.

One embodiment of the present invention is a fuel nozzle for a gas turbine. The fuel nozzle includes a pre-mix flow passage for directing a flow segment of a flow of a working fluid through the fuel nozzle. A first swirler vane and a second swirler vane extend within the pre-mix flow passage. The first swirler vane provides a first wake region within the flow segment. The second swirler vane provides a second wake region within the flow segment. A fuel injection peg is disposed downstream from the first swirler vane and the second swirler vane. The fuel injection peg is positioned within the flow segment between the first wake region and the second wake region.

Another embodiment of the present invention is a combustor for a gas turbine. The combustor generally includes a combustion chamber defined within the combustor and a fuel nozzle that is disposed upstream from the combustion chamber. The fuel nozzle comprises an inner sleeve and an outer sleeve that surrounds at least a portion of the inner sleeve to at least partially define a premix flow passage therebetween. A first swirler vane extends substantially parallel to a second swirler vane within the pre-mix flow passage. A flow segment of a working fluid is directed through the pre-mix flow passage between the first swirler vane and the second swirler vane. The flow segment includes a first wake region that is proximate to the first swirler vane and a second wake region that is proximate to the second swirler vane. A fuel injection peg is within the flow segment between the first wake region and the second wake region.

Another embodiment of the present invention includes a gas turbine. The gas turbine generally includes a compressor, a combustor downstream from the compressor, a combustor chamber defined within the combustor, a turbine downstream from the combustion chamber and a fuel nozzle disposed within the combustor upstream from the combustion chamber. The fuel nozzle includes a pre-mix flow passage for directing a flow segment of a working fluid through the fuel nozzle towards the combustion chamber. A first swirler vane extends substantially parallel to a second swirler vane within the pre-mix flow passage. A first wake region is defined within the flow segment proximate to the first swirler vane. A second wake region is defined within the flow segment proximate to the second swirler vane. A fuel injection peg is disposed within the flow segment between the first wake region and the second wake region.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
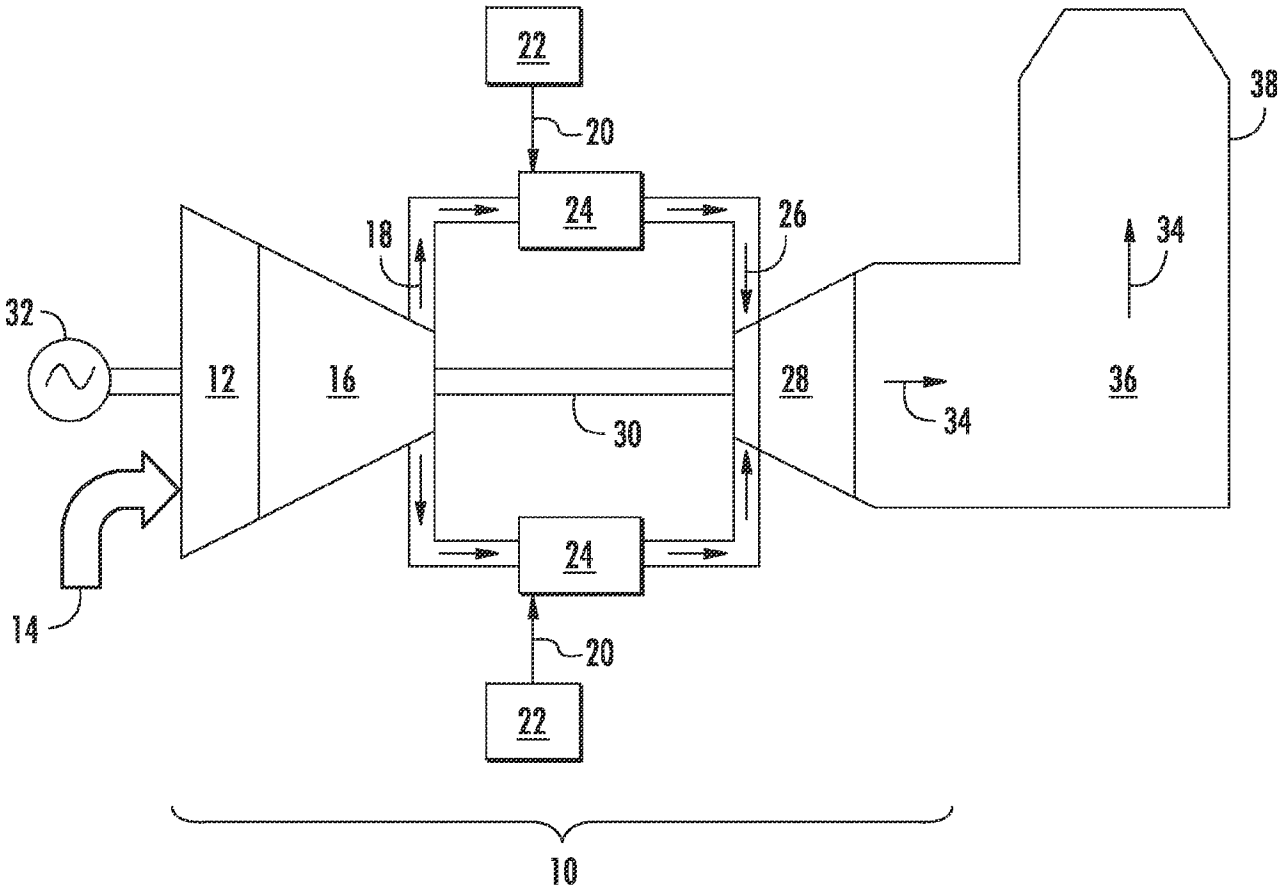
FIG. 1 PRIOR ART
FIG. 1 is a functional block diagram of an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

As used herein, the terms "first", "second", and "third" may be used interchangeably to distinguish one component from another and are not intended to signify location or importance of the individual components. The terms "upstream," "downstream," "radially," and "axially" refer to the relative direction with respect to fluid flow in a fluid pathway. For example, "upstream" refers to the direction from which the fluid flows, and "downstream" refers to the direction to which the fluid flows. Similarly, "radially" refers to the relative direction substantially perpendicular to the fluid flow, and "axially" refers to the relative direction substantially parallel to the fluid flow. The term "circumferentially" refers to a relative direction that extends around an axial centerline of a particular component.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic energy to the working fluid 14 to produce a compressed working fluid 18 at a highly energized state.

The compressed working fluid 18 is mixed with a fuel 20 from a fuel supply system 22 to form a combustible mixture within one or more combustors 24. The combustible mixture is burned to produce combustion gases 26 having a high temperature and pressure. The combustion gases 26 flow through a turbine 28 of a turbine section to produce work. For example, the turbine 28 may be connected to a shaft 30 so that rotation of the turbine 28 drives the compressor 16 to produce the compressed working fluid 18. Alternately or in addition, the shaft 30 may connect the turbine 28 to a generator 32 for producing electricity. Exhaust gases 34 from the turbine 28 flow through an exhaust section 36 that connects the turbine 28 to an exhaust stack 38 downstream from the turbine 28. The exhaust section 36 may include, for example, a heat recovery steam generator (not shown) for cleaning and extracting additional heat from the exhaust gases 34 prior to release to the environment.

Figure 2:
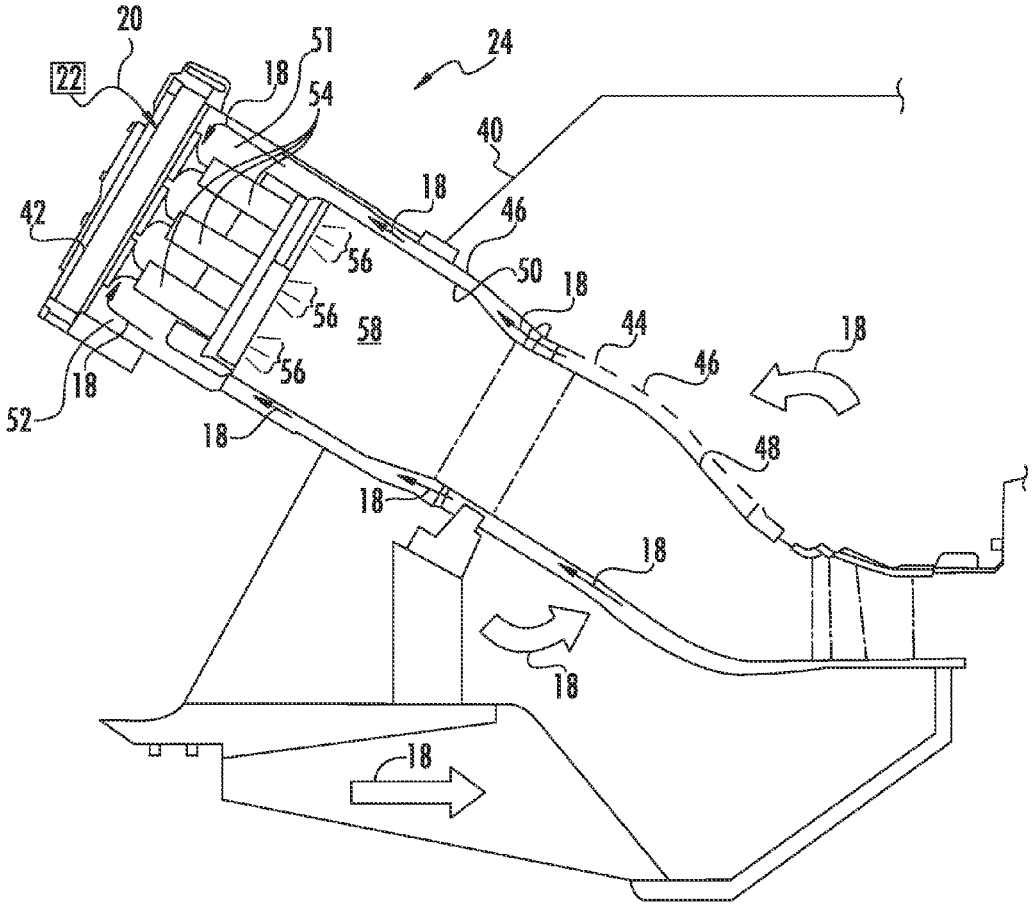
FIG. 2 is a simplified cross-section side view of an exemplary combustor as may incorporate various embodiments of the present invention.

The combustors 24 may be any type of combustor known in the art, and the present invention is not limited to any particular combustor design unless specifically recited in the claims. For example, the combustor 24 may be a can type or a can-annular type of combustor. FIG. 2 provides a simplified cross-section side view of an exemplary combustor 24 that may incorporate various embodiments of the present invention. As shown in FIG. 2, a casing 40 and an end cover 42 combine to contain the compressed working fluid 18 flowing to the combustor 24 from the compressor 16 (FIG. 1). The compressed working fluid 18 may pass through flow holes 44 in an annular flow sleeve 46 such as an impingement sleeve or a combustion flow sleeve to flow along the outside of a transition duct 48 and/or a liner 50 towards a head end 52 of the combustor 22.

The head end 52 is at least partially defined by the end cover 42 and/or the casing 40. The compressed working fluid provides convective cooling to the transition duct 48 and/or to the liner 50 as it flows towards the head end 52. At the head end 52, the compressed working fluid 18 reverses in direction and flows through one or more fuel nozzles 52. The fuel 20 flows from the fuel supply system 22 through one or more fuel circuits (not shown) defined within the end cover 42 and into each or some of the fuel nozzles 54. The fuel supply system 22 may provide a gaseous and/or a liquid fuel to the combustor 24. The compressed working fluid 18 is premixed with the fuel 20 as it passes through and/or around the fuel nozzles 54 to form a combustible mixture 56. The combustible mixture 56 flows from the fuel nozzles 54 and into a combustion chamber 58 that is defined within the combustor 24 downstream from the fuel nozzles 54 for combustion.

Figure 3:
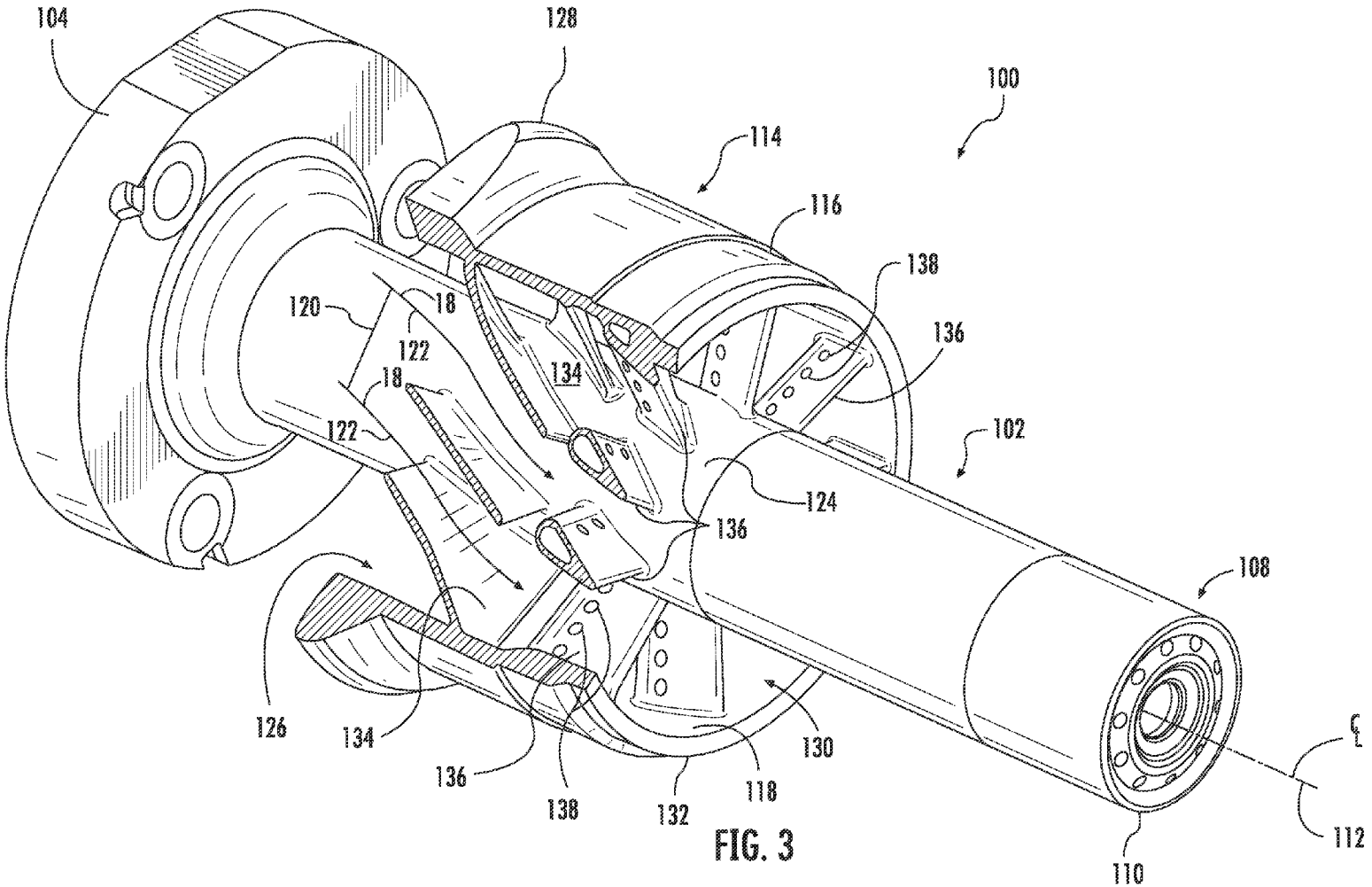
FIG. 3 is a perspective partial cutaway view of an exemplary fuel nozzle that may incorporate various embodiments of the present invention.

FIG. 3 provides a perspective partial cutaway view of an exemplary fuel nozzle 100 that can be implemented within embodiments of the present invention and that is intended to replace at least some of the fuel nozzles 54 shown in FIG. 2. As shown in FIG. 3, the fuel nozzle 100 generally includes a nozzle body 102, a base portion 104 disposed at an upstream end 106 of the fuel nozzle 100 and a nozzle tip 108 disposed at a downstream end 110 of the nozzle body 102. An axial or longitudinal centerline 112 extends through the fuel nozzle 100.

A swirler assembly 114 extends circumferentially around the nozzle body 102. The swirler assembly 114 generally includes an outer sleeve 116. The outer sleeve 116 may be coaxially aligned with the nozzle body 102 with respect to the centerline 112. The outer sleeve 116 is radially separated from the nozzle body 102 so as to define a pre-mix flow passage 118 between the nozzle body 102 and the outer sleeve 116. The pre-mix flow passage 118 directs a flow 120 of a working fluid 122 such as the compressed working fluid 18 through the swirler assembly 114.

In particular embodiments, the swirler assembly 114 may include an inner sleeve 124. The inner sleeve 124 may be coaxially aligned with the nozzle body 102 and/or the outer sleeve 116 with respect to the centerline 112. The inner sleeve 124 may at least partially define the pre-mix flow passage 118 and/or at least a portion of the nozzle body 102. The swirler assembly 114 further includes an inlet 126 defined at an upstream end 128 of the swirler assembly 114 for receiving the flow 120 of the working fluid 122 into the pre-mix flow passage 118 and an outlet 130 defined at a downstream end 132 of the swirler assembly 114 for exhausting the flow 120 of the working fluid 122 from the pre-mix flow passage 118.

In one embodiment, as shown in FIG. 3, the swirler assembly 114 includes a plurality of swirler vanes 134 that extend within the premix flow passage 118. The swirler vanes 134 extend generally axially with respect to centerline 112 at least partially between the upstream end 128 and the downstream end 132 of the swirler assembly 114. The swirler vanes 134 extend generally radially between the outer sleeve 116 and the nozzle body 102 and/or the inner sleeve 124. As shown, the swirler vanes 134 are arranged circumferentially around the inner sleeve 124 and/or the nozzle body 102 within the pre-mix flow passage 118.

A plurality of fuel injection pegs 136 extends within the pre-mix flow passage 118 at least partially between the outer sleeve 116 and the nozzle body 102 and/or the inner sleeve 124. In one embodiment, the fuel injection pegs 136 are positioned downstream from the swirler vanes 134. The fuel injection pegs 136 are arranged circumferentially around the inner sleeve 124 and/or the nozzle body 102 within the pre-mix flow passage 118. In particular embodiments, at least one fuel injection peg 136 of the plurality of fuel injection pegs 136 is positioned between adjacent swirler vanes 134 of the plurality of swirler vanes 134.

At least some of the fuel injection pegs 136 include one or more fuel injection ports 138. The fuel injection ports 138 provide for fluid communication between a fuel source 22 (FIG. 1) and the pre-mix air flow passage 118. The fuel injection ports 138 may be positioned at any point along the fuel injector pegs 136 so as to provide for injection of fuel into the flow 120 of the working fluid 122. In particular embodiments, the fuel injection ports 138 may be aligned or positioned to allow for injection of the fuel into the pre-mix flow passage 118 in a direction that is substantially transverse to the flow 120 of the working fluid 122.

Figure 4:
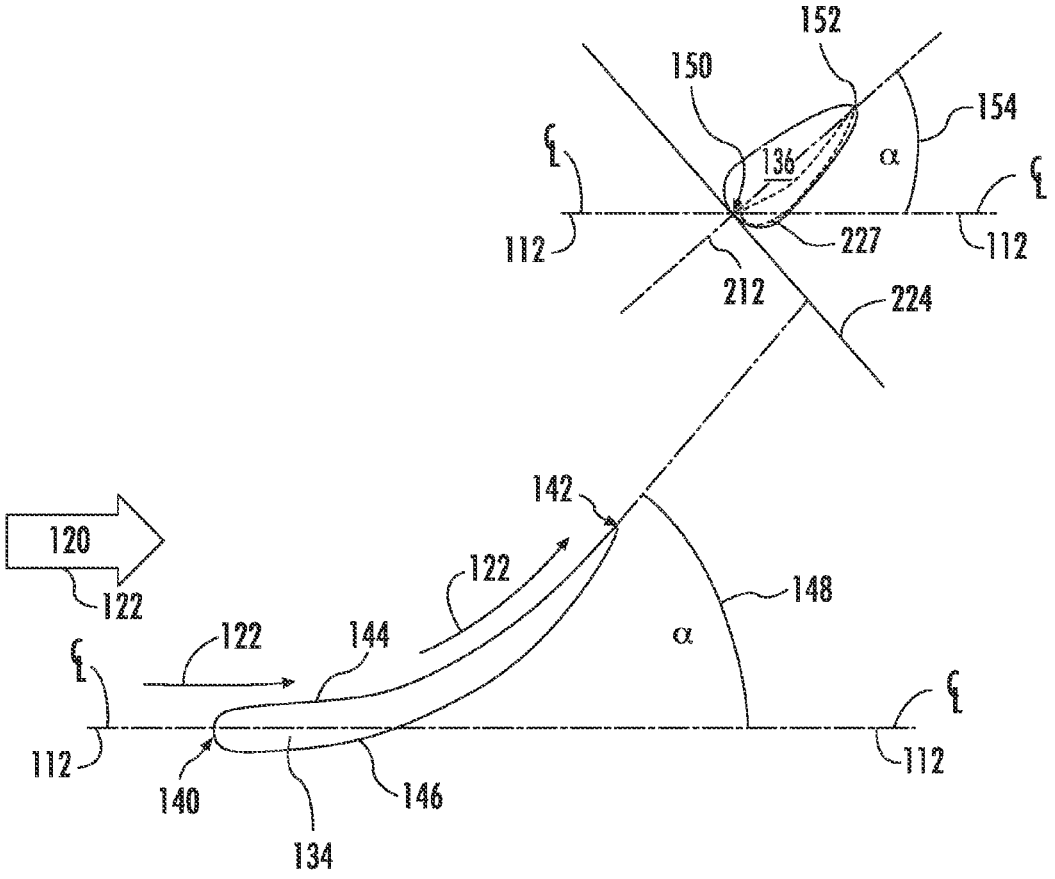
FIG. 4 is a top view of an exemplary swirler vane and an exemplary fuel injection peg, according to at least one embodiment of the present invention.
Figure 5:
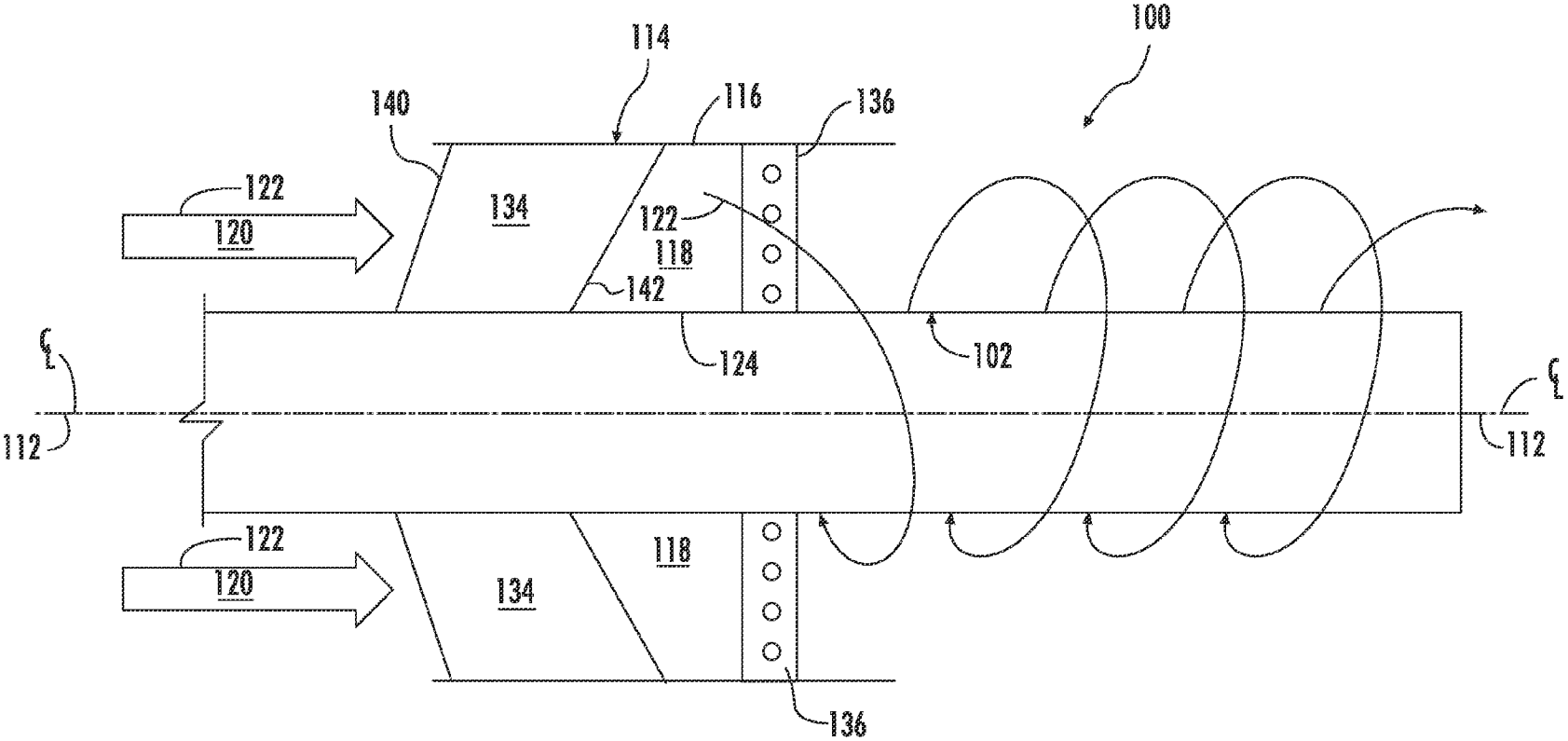
FIG. 5 is a simplified cross section side view of the fuel nozzle as shown in FIG. 3, according to at least one embodiment of the invention.

FIG. 4 provides a cross section top view of an exemplary swirler vane of the plurality of swirler vanes 134 and an exemplary fuel injection peg 136 of the plurality of fuel injection pegs 136 as shown in FIG. 3 that can be implemented within embodiments of the present invention. FIG. 5 provides a simplified cross section side view of a portion of the fuel nozzle 100 including the swirler assembly 114. As shown in FIGS. 4 and 5, each swirler vane 134 includes a leading edge 140, a trailing edge 142. As shown in FIG. 4, each swirler vane 134 includes a pressure side 144 and a suction side 146. The trailing edge 142 is arranged at an angle or swirl angle 148 relative to the axial centerline 112 of the fuel nozzle 100. In this manner, as shown in FIG. 5, the swirler vanes 134 impart angular or circumferential swirl about the axial centerline 112 of the fuel nozzle 100 to the flow 120 of the working fluid 122 as it progresses through the pre-mix flow passage 118 (FIG. 3). As shown in FIG. 5, the angular swirl continues as the working fluid 122 flows across the fuel injection pegs 136 and downstream from the swirler assembly 114 along the nozzle body 102.

In particular embodiments, as shown in FIGS. 3 and 4, the fuel injection pegs 136 may have an airfoil shape. As shown in FIG. 4, each fuel injection peg 136 may include a leading edge 150 and a trailing edge 152. The leading edge 150 may be substantially perpendicular to the flow 120 of the working fluid 122 as it leaves the trialing edge 142 of the swirler vane 134. In one embodiment, the trailing edge 152 is arranged at an angle 154 relative to the axial centerline 112 of the fuel nozzle 100. In various embodiments, the angle 154 of the fuel injection peg 136 may be greater than, less than or the same as the swirl angle 148 of the swirler vanes 134 so as to at least partially align the fuel injection peg 136 with the flow 120 of the working fluid 122 within the pre-mix flow passage 118.

Figure 6:
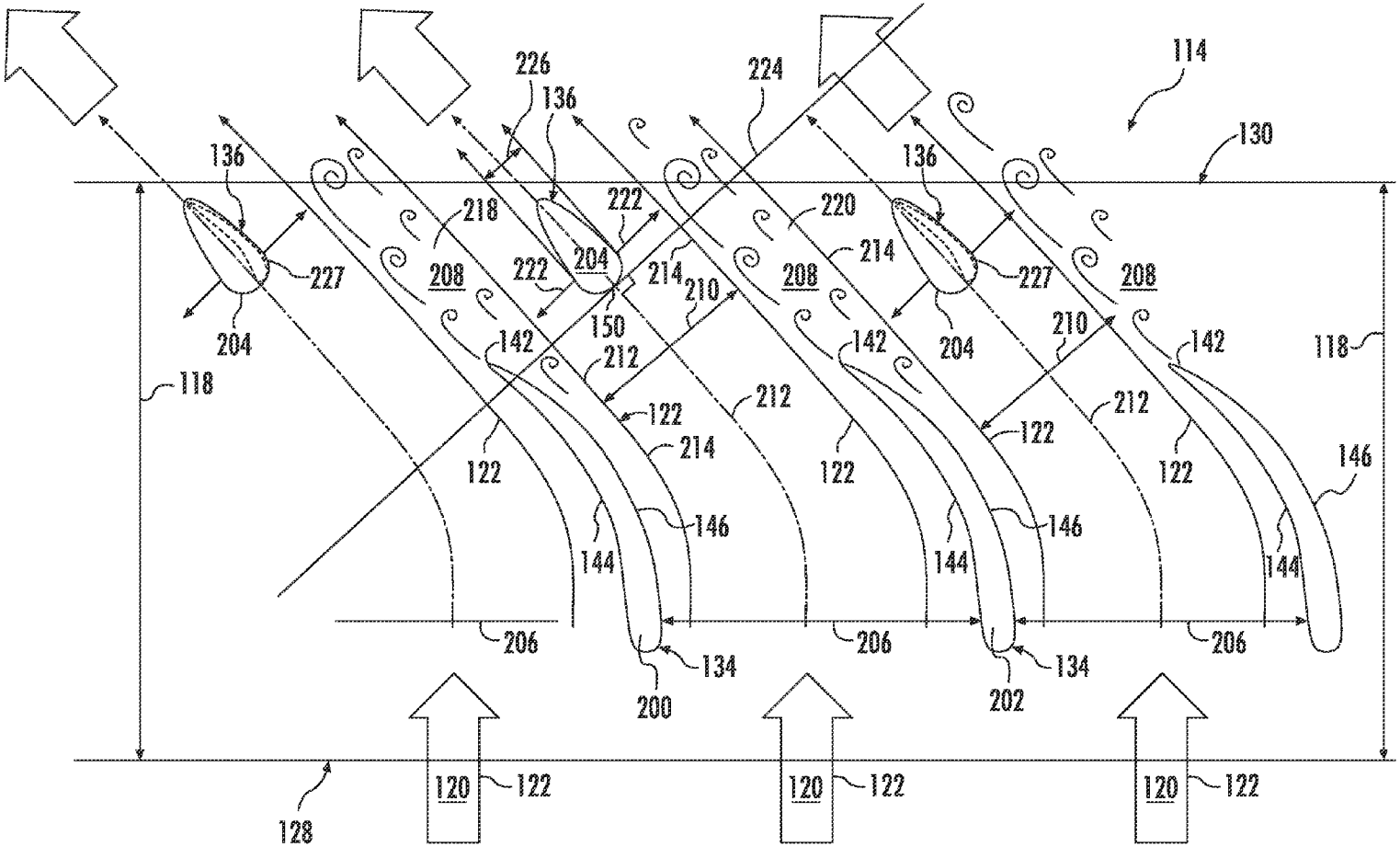
FIG. 6 is a cross section top view of a portion of the fuel nozzle as shown in FIG. 3, according to at least one embodiment of the invention.

FIG. 6 provides a top view of three adjacent swirler vanes 134 of the plurality of swirler vanes 134 and three adjacent fuel injection pegs 136 of the plurality of fuel injection pegs 136 disposed within the premix flow passage 118 according to various embodiments of the present invention. In one embodiment, the plurality of swirler vanes 136 comprises at least a first swirler vane 200, an adjacent second swirler vane 202, and a fuel injection peg 204 of the plurality of fuel injection pegs 136 that is disposed downstream from the first and the second swirler vanes 200, 202.

In operation, the flow 120 of the working fluid 122 is guided through the inlet 126 of the swirler assembly 114 where it is divided into individual flow segments 206 as the working fluid 122 is routed between each adjacent swirler vane 134. The pressure side 144 of each swirler vane 134 guides a corresponding flow segment 206 of the working fluid 122 through the pre-mix flow passage 118, thereby generating or imparting angular or circumferential swirl to the flow segment 206. As the flow segment 206 separates from the pressure side 144 at or near the trailing edge 142 of the swirler vane 134, a wake region or region of irregular flow 208 is produced downstream from the swirler vane 134. The wake region 208 may be further defined as an adjacent flow segment 206 separates from the suction side 146 of the same swirler vane 134.

A uniform flow region 210 within each flow segment 206 is defined between adjacent wake regions 208. As used herein, the term "uniform flow region" corresponds to a region of each flow segment 206 that is generally bounded between adjacent wake regions 208, wherein a flow field of the flow segment 206 is substantially uniform. The uniform flow region 210 of each flow segment 206 generally extends downstream from the trailing edges 142 of the corresponding adjacent swirler vanes 134 along a flow segment centerline 212.

In particular embodiments, the uniform flow region 210 of each flow segment 206 is defined between an inner wake boundary 214 and an outer wake boundary 216. The inner wake boundary 214 and the outer wake boundary 216 are generally defined as flow boundaries where a wake region 208 of each flow segment 206 transitions to from an irregular flow to a uniform flow field as found in the uniform flow region 210. The inner wake boundary 214 is generally defined proximate to the suction side 146 of one swirler vane 134 and the outer wake boundary 216 is defined proximate to the pressure side of an adjacent swirler vane 134.

In one embodiment, the flow segment centerline 212 is defined between the first wake region 206 and the second wake region 210. In one embodiment, the flow segment centerline 218 is defined between the inner wake boundary 214 and the outer wake boundary 216 of the flow segment 206. In one embodiment, the flow segment centerline 212 is position a substantially equal distance from the inner wake boundary 214 and the outer wake boundary 216 with respect to a plane that extends perpendicular to the flow segment centerline 218.

In one embodiment, the fuel injection peg 204 is disposed downstream from the first swirler vane 200 and the second swirler vane 202 between a first wake region 218 and a second wake region 220 within the uniform flow region 210. In one embodiment, the fuel injection peg 204 is positioned within the uniform flow region 210 a distance that is substantially equal from the inner wake boundary 214 of the first wake region 218 and the outer wake boundary 216 of the second wake region 220 as measured in a plane 224 that extends perpendicular to the flow segment centerline 212.

In particular embodiments, the fuel injection peg 204 is aligned with the flow segment centerline 212 within the uniform flow region 210. In another embodiment, the fuel injection peg 204 may be set at an angle 154 (FIG. 4) that is oblique or acute to the flow segment centerline 212. In another embodiment, as shown in FIG. 6, the leading edge 150 of the fuel injection peg 204 is aligned with the flow segment centerline. In another embodiment, the leading edge 150 and the trailing edge 152 of the fuel injection peg 204 are each aligned with the flow segment centerline. As the working fluid flows past the fuel injection peg, a peg flow field 226 is formed within the uniform flow region 210.

In one embodiment, the peg flow field is substantially aligned with the uniform flow region 210 of the flow segment 206. In one embodiment, as shown by dotted lines 227 in FIGS. 4 and 6, the flow pegs 136 maintain a radial contour between the inner sleeve 124 (FIG. 3) and the outer sleeve 116 (FIG. 3) that is consistent with a radial contour of the swirler vanes 200 and 202 such that the peg is positioned within the uniform flow region 210 radially between the inner sleeve 124 and the outer sleeve 116. The various positions of the fuel injection pegs 134 disclosed in the various embodiments presented reduce and/or prevent irregular flow fields that may extend downstream from the fuel injection peg 136. As a result, recirculation zones may be reduced downstream from the pre-mix flow passage 118, thereby reducing a propensity for flame holding.

Determination and/or verification of the location of the wake regions 208, the inner and outer wake boundaries 214, 216 the uniform flow field 210, the peg flow field 226 and/or the proper alignment or positioning of the fuel peg(s) 204, 136 according to the various embodiments presented herein may be accomplished by any means known in the art for determining fluid flow fields between two adjacent air foils, for example, by computational fluid dynamics modeling, flow stream analysis and/or by determining the position of the flow segment centerline by measuring a distance between two lines that extend tangent to the trailing edges 142 of two adjacent swirler vanes 134.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal language of the claims.

What is claimed:

1. A fuel nozzle for a combustor, the fuel nozzle comprising:

a nozzle body;

an outer sleeve circumferentially surrounding at least a portion of the nozzle body, wherein the outer sleeve and the nozzle body define a premix flow passage therebetween;

a first swirler vane circumferentially spaced from a second swirler vane, wherein the first and second swirler vanes extend from the nozzle body to the outer sleeve within the premix flow passage, and a trailing edge of the first and second swirler vanes each form a first angle relative to an axial centerline of the nozzle body;

a fuel injection peg having an airfoil shape comprising a leading edge, a trailing edge, a pressure side, and a suction side that extends from the nozzle body to the outer sleeve, wherein the leading edge of the fuel injection peg is positioned downstream from a trailing edge of the first swirler vane and a trialing edge of the second swirler vane within the premix passage, and the trailing edge of each fuel injection peg forming a second angle relative to the axial centerline of the nozzle body that is the same as the first angle; and;

a uniform flow region that is formed circumferentially between the first swirler vane and second swirler vane and extends downstream the first and second swirler vanes along a direction of the second angle;

wherein the fuel injection peg maintains a radial contour between the nozzle body and outer sleeve that is consistent with a radial contour of the swirler vanes, such that the fuel injection peg is positioned within the uniform flow region, and the leading edge of the fuel injection peg is circumferentially offset from the trailing edge of the first swirler vane and circumferentially offset from the trailing edge of the second swirler vane.

2. The fuel nozzle as in claim 1, wherein the trailing edge of the fuel injection peg is circumferentially offset from the trailing edge of the first swirler vane and circumferentially offset from the trailing edge of the second swirler vane.

3. The fuel nozzle as in claim 1, wherein the fuel injector peg includes at least one fuel injection port.

4. The fuel nozzle as in claim 1, wherein the fuel injector peg includes at least one fuel injection port disposed along the concave pressure side wall.

5. The fuel nozzle as in claim 1, wherein the fuel injector peg includes at least one fuel injection port disposed along the convex suction side wall.

6. A combustor, comprising:

a plurality of fuel nozzles radially and circumferentially arranged across an end cover and extending axially downstream from the end cover within an outer casing, at least one fuel nozzle of the plurality of fuel nozzles comprising:

a nozzle body;

an outer sleeve circumferentially surrounding at least a portion of the nozzle body, wherein the outer sleeve and the nozzle body define a premix flow passage therebetween;

a plurality of swirler vanes circumferentially spaced about the nozzle body and extending from the nozzle body to the outer sleeve within the premix flow passage, each swirler vane having a trailing edge that forms a first angle relative to an axial centerline of the nozzle body;

a plurality of fuel injection pegs disposed within the premix passage, each fuel injection peg having an airfoil shape comprising a leading edge, a trailing edge, a pressure side and a suction side that extends from the nozzle body to the outer sleeve, wherein the leading edge of each fuel injection peg is positioned downstream from a corresponding pair of circumferentially adjacent trailing edges of circumferentially adjacent swirler vanes of the plurality of swirler vanes, and the trailing edge of each fuel injection peg forming a second angle relative to the axial centerline of the nozzle body that is the same as the first angle; and a uniform flow region that is formed circumferentially between the first swirler vane and second swirler vane and extends downstream the first and second swirler vanes in a direction of the second angle;

wherein each of the fuel injection pegs maintains a radial contour between the nozzle body and outer sleeve that is consistent with a radial contour of the corresponding circumferentially adjacent swirler vanes, such that the fuel injection peg is positioned within the uniform flow region, and the leading edge of each fuel injection peg is circumferentially offset from the trailing edges of the corresponding circumferentially adjacent swirler vanes of the plurality of swirler vanes.

7. The combustor as in claim 6, wherein the trailing edge of each fuel injection peg is circumferentially offset from the trailing edges of the corresponding circumferentially adjacent swirler vanes of the plurality of swirler vanes.

8. The combustor as in claim 6, Wherein at least one fuel injector peg of the plurality of fuel injector pegs includes at least one fuel injection port.

9. The combustor as in claim 6, wherein at least one fuel injector peg of the plurality of fuel injector pegs includes at least one fuel injection port disposed along the pressure side wall.

10. The combustor as in claim 6, wherein at least one fuel injector peg of the plurality of the injector pegs includes at least one fuel injection port disposed along the suction side wall.

* * * * *